United States Patent [19]

Bienz

[11] 4,142,015

[45] Feb. 27, 1979

[54] THERMAL CAMOUFLAGE

[75] Inventor: Earl F. Bienz, Locust Grove, Va.

[73] Assignee: The United States of America as represented by the Secretary of the Army, Washington, D.C.

[21] Appl. No.: 793,690

[22] Filed: May 4, 1977

[51] Int. Cl.[2] ..... F41H 3/00; B32B 3/00

[52] U.S. Cl. ..... 428/159; 428/160; 428/919

[58] Field of Search ..... 428/159, 160, 919

[56] References Cited

U.S. PATENT DOCUMENTS

| | | | |
|---|---|---|---|
| 3,870,540 | 3/1975 | Norgard | 428/159 X |
| 3,963,847 | 6/1976 | Norgard | 428/159 X |

*Primary Examiner*—James R. Hoffman

*Attorney, Agent, or Firm*—Nathan Edelberg; Milton W. Lee; John E. Holford

[57] ABSTRACT

A thermal and visible camouflage is provided for military equipment and the like, which consists of a layer of foamed plastic that varies randomly in its insulating effect as a function of its position on the surface and may also include uniform coatings under the layer on the hottest portions of the surface.

8 Claims, 6 Drawing Figures

THERMAL CAMOUFLAGE

The invention described herein may be manufactured, used, and licensed by the U.S. Government for governmental purposes without the payment of any royalties thereon.

BACKGROUND OF THE INVENTION

The art of infrared (IR) detection has made great strides in recent years. The first detectors used oil films and other types of continuous retina type detecting elements in which lateral heat conduction erased most of the fine detail before the image could be properly evaluated. To overcome this, and a lack of sensitivity in general, the art turned to discrete solid state detectors. Resolution thus become a function of the size of the detecting element and the magnification of the optics, both of which were severely limited by practical considerations of portability and cost. Now with the advent of insulated gate devices and charge coupled arrays the resolution of these detectors is increasing by orders of magnitude.

The effectiveness of these detectors against hostile targets, particularly in military situations has been phenomenal. Being passive devices they can be operated in almost any situation without alerting the target being detected. Also, the most interesting targets, i.e., tanks, trucks, operating weapons and power generators; naturally provide a great contrast to the surrounding environment.

About the only way to defeat these systems is to provide decoys or sources which radiate infrared equal to that of any specific target. For certain targets this is very difficult. Some targets contain highly concentrated heat sources which produce very high localized temperatures. There are also targets that contain a large number of heat sources with distinctive shapes which form easily recognizeable patterns. As the contrast sensitivity of solid state detectors improves it becomes possible to discern, for example, the number of cylinders in a gasoline engine and other subtle distinctions such as a change in fabrication material or perhaps a particular type of seam. If this capability could be defeated the target might be ignored as a less important target or in some cases even mistaken for a naturally occurring phenomenon such as a sun heated rock.

BRIEF DESCRIPTION OF THE INVENTION

An object of the invention is therefore to provide a means or method of camouflaging IR targets using inexpensive foamed plastics. It is a further object to combine the above means and methods with camouflage for purely visible detectors.

DESCRIPTION OF INVENTION

Figure 1:
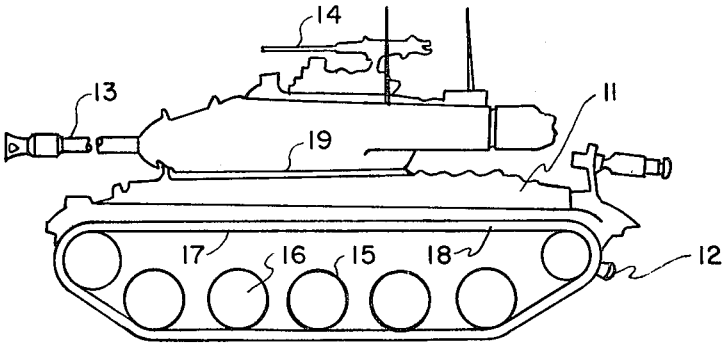
FIG. 1 shows a typical infrared target, in this instance an Army tank.

Referring to the typical target or tank shown in FIG. 1 there are a number of characteristics which make this an excellent candidate for detection. First and foremost it poses a considerable threat to personnel, most weapons systems, vehicles and communications systems. Secondly, it represents a major investment of capital. And lastly, it is by nature easy to detect.

The main reason it is easy to detect is due to the fact that it contains a large amount of steel. On a sunny day, this steel stores a great deal of radiant energy from the sun and reradiates it at night against a relatively cool background such as trees and hills. When running, large amounts of heat are generated in the engine compartment 11 and exhaust pipe 12. When the guns 13 and 14 are fired their barrels become heat sinks. Friction while the tank is moving heats the rims 15 of the drive and idler wheels and their central bearing portions 16. The track 18 also becomes heated by friction with the wheels. The bearing area 19 between the turret and tank can also become heated.

Figure 2:
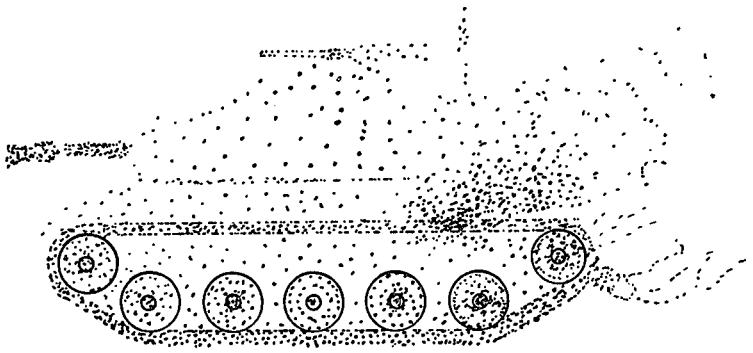
FIG. 2 shows a simulated image of the tank in FIG. 1 as it might appear in a thermal viewer; and FIGS. *3a–3d* shows the effect of a foam camouflage according to the present invention on various heat sources that are encountered in thermal targets including that shown in FIGS. 1 and 2.

FIG. 2 shows a simulated view of the tank in FIG. 1 as seen through a thermal (IR) viewer. These viewers operate in the region of light wavelengths between 1 and 15 microns, which correspond to blackbody (target) temperatures between 200° and 3000° Kelvin. After the tank has been in full operation, i.e., moving at high speed, swiveling its turret and firing its rifles; its image is unmistakeable. A trained operator can obviously make a positive identification with even less information. The salient details are obvious, the number of wheels in the track, the relative size and position of guns, etc. The resolution of imagers, however, make it possible for anyone to identify a specific tank or weapon system with much less but more accurate detail. Future detection systems will extend their capability by storing data and performing correlation studies by computers.

To defeat such a detector it is not necessary or even desirable in some cases, to reduce radiation levels of the target to the background level. This would hardly be practical in every case, since all of the background levels are difficult to predict. The information which should be disguised is the relative levels radiated by various areas of the target and their relative positions. This, of course, must be done without interference to the function of the target device, while assuring a useful life of the camouflage agent.

Figure 3A:
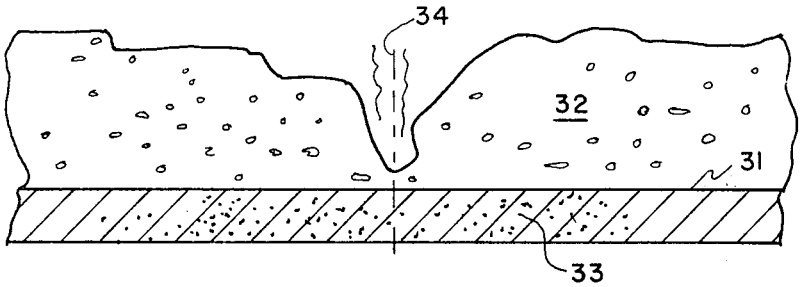

FIGS. *3a–3d* show a series of typical surface portions of a target coated with a thermal camouflage agent according to the present invention and some of types of observing effects that occur. The skin or surface 31 of the target, which is generally metal or a similar reasonably good conductor of heat. Due to localized heat sources as discussed, for example, in FIGS. 1 and 2; there will be localized heat spots, such as the rather broad area 33 shown in FIG. *3a*. The camouflage coating 32, proposed by the present invention, consists of a foamed plastic, which can be sprayed, painted or glued onto the surface of the target. The heat insulating effect of the foam is made to vary by changing its thickness, as shown, or it could be accomplished by varying the density of the foam. The material of the foam depends on the maximum temperatures developed by the target so that plastics with high melting points are most desirable. Foams of polystyrene or polyurethane are considered suitable for the temperatures found on tank surfaces. Silicone rubber is a possible candidate for even higher temperatures. The maximum thickness of the coating should be sufficient to reduce the maximum radiation areas of tank at least to the average background level expected. This may amount to no more than one to four millimeters of the coating materials mentioned above. The maximum thickness of the layer is best determined empirically by uniformly coating a first small metal plate heated to the maximum temperature on the target, while viewing the first, and a second plate held at a chosen background temperature, through a thermal viewer. The thickness which makes the first and second plates equally visible is the ideal for that target and background. Another excellent technique is to monitor the target device with a thermal viewer while the foam is being applied. It is possible to leave some areas uncoated, but this is not preferred since uniform radiation from the sun affects all areas, and wear and tear will normally provide a fairly large number of such areas automatically in any event. The important aspect of the coating according to this invention is that its insulating effect varies randomly with position on the surface. The surface configuration shown in FIG. 3*a* thus reduces the broad hot spot 33 to a narrowly localized one centered at line 34.

Figure 3B:
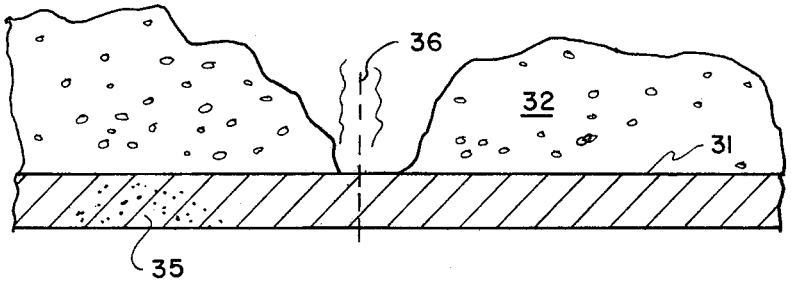

FIG. 3*b* shows a different area of the target skin 31 containing a narrowly localized hot spot 35 the configuration of the coating here is such that the hot spot is displaced to a new spot centered at line 36. In the process the hot spot may be broadened or narrowed depending on the slope of the coating. The greater the slope the narrower the spot.

Figure 3C:
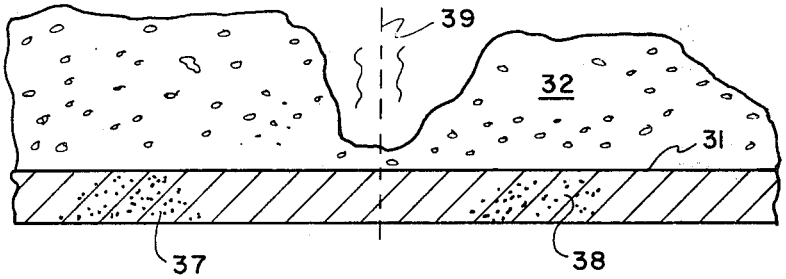

Another interesting effect is shown in FIG. 3*c*. Here the skin has two closely spaced narrow localized hot spots 37 and 38; the coating shifts the radiation so that they appear as a single hot spot centered at the line 39. The effect of such a change on a correlating detector is obvious.

Figure 3D:
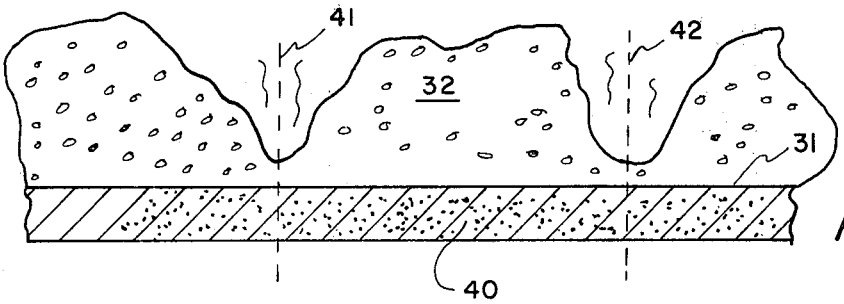

One other effect worth noting is shown in FIG. 3*d*. In this case, the hot spot 40 is again a broad area effect. The local shape of the coating 32 is such that an imager would instead see two small hot spots centered at lines 41 and 42. This effect can obviously be extended to produce three or more small hot spots from one broad spot.

In applying the coating 32, it must be recognized that the heat from the target must somehow be dissipated. In the case of a tank, for example, there must at least be an exhaust plume. This plume, however, does not provide any significant information to an infrared viewer. Similarly heat from a hot spot that is convected off, rather than directly radiated, supplies little information to a detector. On this hypothesis, one might suspect that a uniform thich coating of insulation everywhere might defeat a viewer. The result, however, would be to present a uniformly cool target against a contrasting (usually depending on the time of day) background. There may be some merit, however, in applying a first uniform at least over the hottest portions of the target surface coating at least over the hot spots or hottest portions of the target surface to reduce the total radiation and then to apply a second random coating over the first. After the foam is applied it can be painted with the usual camouflage patterns. A further simplification would be to simply add a pigment to the plastic material before it is foamed. In the coating method which utilizes a spray gun for the plastic, pigment can be added during the spraying operation. All areas of the same color may be applied in one step or the plastic reservoir of the gun can be changed to different colors in sequence as the spraying proceeds. A gun could also be designed to automatically switch pigments at random intervals as the spraying proceeds.

Many variations of the above methods and coatings will be immediately apparent to those skilled in the art, but the invention is to be limited only as defined in the claims, which follow.

I claim:

1. Camouflage means to disguise the infrared signature of a target device having a recognizeable pattern of relatively hot portions on the surface thereof compared to the temperature of its natural background comprising:

a surface layer of foamed plastic substantially covering said device, said surface layer varying in heat insulating effect as a random function of position on said surface.

2. Camouflage means according to claim 1 wherein: at least the hottest portions of said surface are coated with a uniform coating of foamed plastic; and said layer covers said coating.

3. Camouflage means according to claim 1 where said target is silhouetted against a background of having a cooler temperature than said target, wherein:

a maximum thickness of said layer is sufficient to reduce the temperature of the hottest part of said target to said cooler temperature.

4. Camouflage means according to claim 1 wherein: different portions of said layer have different colors.

5. Camouflage means according to claim 1 wherein: said foam layer has a substantially uniform density and varying thickness

6. Camouflage means according to claim 1 wherein: said foam layer has a varying density.

7. Camouflage means according to claim 1 wherein: said foam layer and coating are formed from polystyrene.

8. Camouflage means according to claim 1 wherein: said foam layer and coating are formed from polyurethane.

* * * * *